US008965252B2

(12) United States Patent
Watanabe

(10) Patent No.: US 8,965,252 B2
(45) Date of Patent: Feb. 24, 2015

(54) DEVELOPING DEVICE AND IMAGE FORMING APPARATUS

(75) Inventor: Yoichi Watanabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 215 days.

(21) Appl. No.: 13/491,270

(22) Filed: Jun. 7, 2012

(65) Prior Publication Data

US 2013/0164043 A1 Jun. 27, 2013

(30) Foreign Application Priority Data

Dec. 22, 2011 (JP) ..... 2011-281395

(51) Int. Cl.
*G03G 15/09* (2006.01)

(52) U.S. Cl.
USPC ..... 399/269; 399/274

(58) Field of Classification Search
CPC G03G 15/0812; G03G 15/09; G03G 15/0921
USPC ..... 399/269, 274; 491/269, 274
See application file for complete search history.

(56) References Cited

U.S. PATENT DOCUMENTS

| | | | | |
|---|---|---|---|---|
| 4,063,533 | A * | 12/1977 | White | 399/269 |
| 5,995,790 | A * | 11/1999 | Takeda | 399/274 |
| 2006/0216069 | A1 | 9/2006 | Tsujita et al. | |
| 2011/0229215 | A1 * | 9/2011 | Hirota et al. | 399/269 |

FOREIGN PATENT DOCUMENTS

| | | |
|---|---|---|
| JP | 2006-267891 A | 10/2006 |
| JP | 2007-047639 A | 2/2007 |

* cited by examiner

*Primary Examiner* — David Gray
*Assistant Examiner* — Gregory H Curran
(74) *Attorney, Agent, or Firm* — Sughrue Mion, PLLC

(57) ABSTRACT

A developing device includes a first developing roller including a first transport member that transports magnetic developer by rotating while being close to a latent-image carrier rotating in one direction and a first magnet member, a second developing roller including a second transport member that transports the developer by rotating while being close to the latent-image carrier at a position on a downstream side of the first developing roller in the one direction, and a second magnet member, and a regulation member that regulates transport amounts of the developer distributed to the first and second developing rollers to required transport amounts, and opposes the developing rollers with predetermined distances therebetween. The first and second developing rollers are spaced from each other. The regulation member is movably supported in an area closer to the latent-image carrier than a closest position between the first and second developing rollers.

3 Claims, 9 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2011-281395 filed Dec. 22, 2011.

BACKGROUND (i) Technical Field

The present invention relates to a developing device and an image forming apparatus.

(ii) Related Art

Image forming apparatuses, such as a printer, a copying machine, and a facsimile machine, using an image recording method, such as an electrophotographic method or an electrostatic recording method, are equipped with developing devices for developing an electrostatic latent image formed on a latent-image carrier, such a photoconductor, with developer.

Among such developing devices, there is a developing device including at least a developing roller that holds developer showing magnetism by magnetic force and rotates to transport the developer to a developing region opposing a latent-image carrier, and a regulation member set such that an end thereof is kept at a predetermined distance from the developing roller. The regulation member uniformly regulates the layer thickness (transport amount) of developer to be supplied to a surface of the developing roller and transported to the developing region. Here, developer showing magnetism is, for example, a two-component developer containing nonmagnetic toner and magnetic carriers, or a magnetic one-component developer. For example, the developing roller is a developer holding transport body including a rotary cylindrical transport member, and a magnet member fixed to an inner side of the transport member to generate magnetic force lines for holding the developer on an outer peripheral surface of the transport member by magnetic force.

SUMMARY

According to an aspect of the invention, there is provided a developing device including: a first developing roller including a substantially cylindrical first transport member that transports developer showing magnetism by rotating while being close to a latent-image carrier rotating in one direction, the first transport member moving in a direction opposite the one direction, and a first magnet member fixed to an inner side of the first transport member and including a plurality of magnetic poles; a second developing roller including a substantially cylindrical second transport member that transports the developer showing the magnetism by rotating while being close to the latent-image carrier at a position on a downstream side of the first developing roller in the one direction, the second transport member moving in the same direction as the one direction, and a second magnet member fixed to an inner side of the second transport member and including a plurality of magnetic poles; and a regulation member that distributes the developer to be supplied to the first developing roller and the second developing roller so as to regulate transport amounts of the developer on the first and second developing rollers to required transport amounts, the regulation member opposing the first and second developing rollers with predetermined distances therebetween in an axial direction of the first and second developing rollers. The first developing roller and the second developing roller are spaced from each other in a vertical direction parallel to a gravitational direction or an oblique direction obliquely intersecting the gravitational direction, and the first and second magnet members of the first and second developing rollers include magnetic poles that apply equal magnetic forces to the regulation member. The regulation member is movably supported in an area closer to the latent-image carrier than a position where the first developing roller and the second developing roller are closest to each other, and the regulation member is formed by one substantially bar-shaped member showing magnetism.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
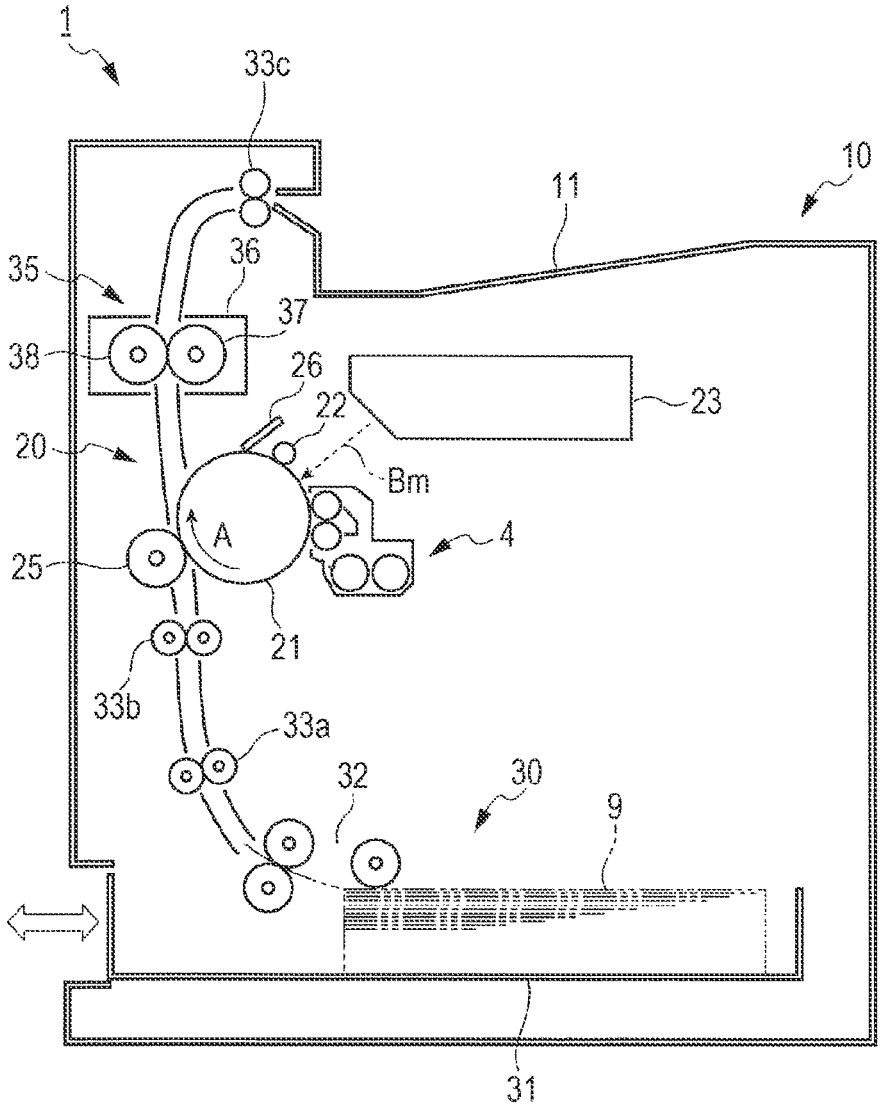
FIG. 1 illustrates the principal part of an image forming apparatus using a developing device according to a first exemplary embodiment.
Figure 2:
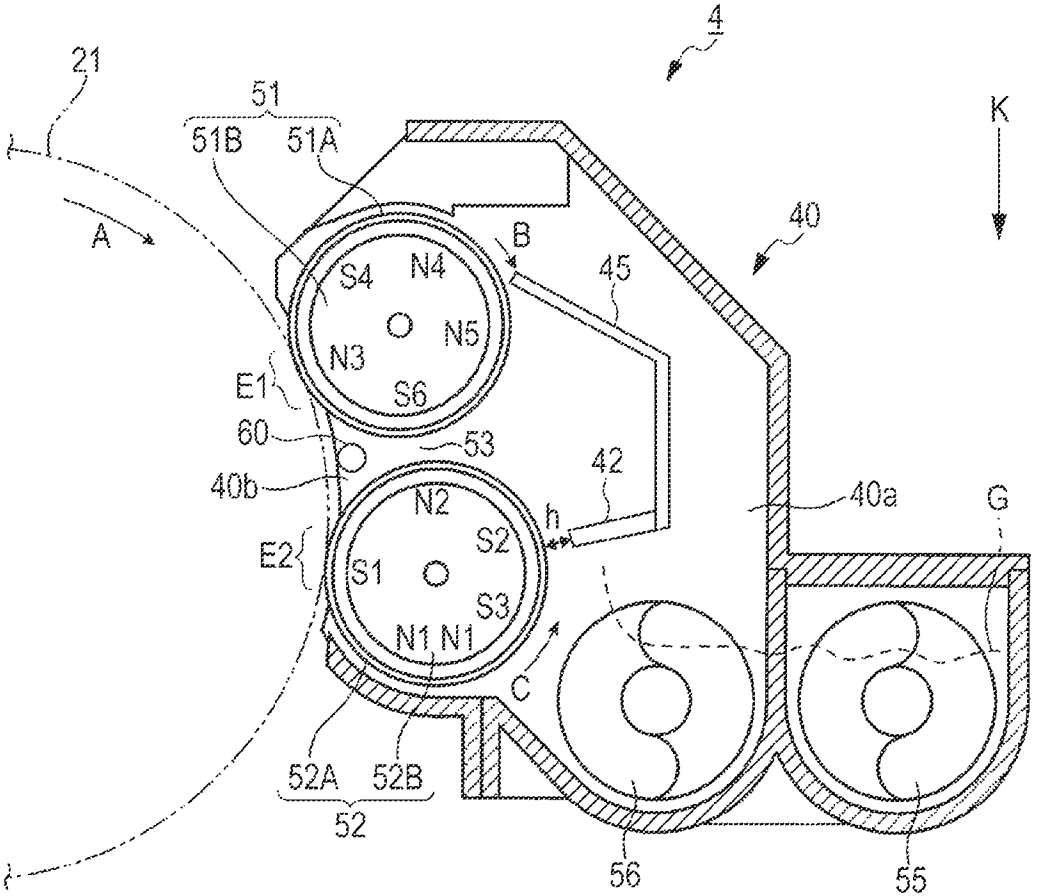
FIG. 2 is a schematic cross-sectional view of the developing device used in the image forming apparatus of FIG. 1.

FIGS. 1 and 2 illustrate an image forming apparatus 1 to which a developing device 4 according to a first exemplary embodiment is applied. FIG. 1 schematically illustrates the image forming apparatus 1, and FIG. 2 schematically illustrates the developing device 4.

As illustrated in FIG. 1, the image forming apparatus 1 includes, in an inner space of a housing 10 formed by a support member, an exterior material, etc., an image forming device 20 that forms a toner image with developer and transfers the toner image onto a sheet 9, a paper feed device 30 that stores and feeds out sheets 9 to be supplied to the image forming device 20, and a fixing device 35 that fixes the toner image transferred by the image forming device 20 onto a sheet 9.

For example, the image forming device 20 utilizes a known electrophotographic method. The image forming device 20 principally includes a photoconductor drum 21, a charging unit 22, an exposure unit 23, a developing device 4, a transfer unit 25, and a cleaning unit 26. The photoconductor drum 21 rotates in a direction of arrow A (a clockwise direction in the figures). The charging unit 22 charges a peripheral surface of the photoconductor drum 21 to the required potential. The exposure unit 23 forms an electrostatic latent image having a potential difference by applying light Bm based on image information (signals) onto the charged peripheral surface of the photoconductor drum 21. The developing device 4 develops the electrostatic latent image with toner serving as developer into a toner image. The transfer unit 25 transfers the toner image onto a sheet 9. The cleaning unit 26 removes toner and the like remaining on the peripheral surface of the photoconductor drum 21 after transfer.

As the photoconductor drum 21, for example, a photosensitive layer made of an organic conductive material is formed on an outer peripheral surface of a grounded cylindrical conductive base body. The charging unit 22 is of a contact type or a non-contact type. The exposure unit 23 is formed by a laser beam scanning unit using a semiconductor laser and various optical components in combination, or an LED array using a plurality of light-emitting diodes (LEDs) and various optical components in combination. The exposure unit 23 performs exposure by applying light Bm based on an image signal that is obtained by subjecting image information to required processing in an unillustrated image processing device. The image information is input from an image generation source connected to or mounted in the image forming apparatus 1, for example, a document reading device, an external connection device, or a storage-medium reading device.

The developing device 4 uses two-component developer G containing nonmagnetic toner and magnetic carriers (particles). As illustrated in FIG. 2 and other figures, the developing device 4 adopts two developing rollers 51 and 52. Details of the developing device 4 will be described below.

The transfer unit 25 is of a contact type or a non-contact type. In the cleaning unit 26, for example, a cleaning blade in contact with the peripheral surface of the photoconductor drum 21 is also in contact with a rotary brush. When an image forming operation is performed, a charging voltage, a developing voltage, and a transfer voltage are supplied from an unillustrated power supply device to the charging unit 22, the developing device 4 (developing rollers 51 and 52), and the transfer unit 25, respectively.

The paper feed device 30 includes a paper container 31 in which a plurality of sheets 9 of the required size or type to be used for image formation are stacked, and a feeding unit 32 that feeds out the sheets 9 stored in the paper container 31 one by one toward a sheet transport path. In image formation, the paper feed device 30 feeds out and supplies necessary sheets 9 one by one to a transfer position in the image forming device 20. The paper container 31 is attached to be drawn into and out of the housing 10 in a direction of a double-headed arrow. According to the usage manner, a plurality of paper containers 31 are mounted.

In the housing 10, there is provided a transport path in which a sheet 9 fed out from the paper feed device 30 is transported to the transfer position in the image forming device 20 and is further transported to an output and storage portion 11 provided in an upper part of the housing 10. The transport path is defined by a plurality of pairs of transport rollers 33*a*, 33*b*, and 33*c*, a transport guide member, etc.

The fixing device 35 has a heating rotating body 37 and a pressurizing rotating body 38 in a casing 36. The heating rotating body 37 is shaped like a roller or a belt that is rotationally driven, and a surface thereof is heated by a heater to maintain a required surface temperature. The pressurizing rotating body 38 is shaped like a roller or a belt that is rotated along with the rotation of the heating rotating body 37 while being in contact with the heating rotating body 37 almost in an axial direction with a required pressure. In the fixing device 35, fixing is performed by passing a sheet, on which a toner image is transferred, through a fixing portion provided between the heating rotating body 37 and the pressurizing rotating body 38.

The image forming apparatus 1 performs image formation as follows. Here, a basic image forming operation for forming an image on one surface of a sheet 9 will be described as an example.

When the image forming apparatus 1 receives a command to start an image forming operation, the photoconductor drum 21 starts rotation, the outer peripheral surface of the photoconductor drum 21 is charged to a predetermined polarity and a predetermined potential by the charging unit 22 in the image forming device 20, and the charged outer peripheral surface of the photoconductor drum 21 is exposed by the exposure unit 23 according to image information, so that an electrostatic latent image having a required potential difference is formed. Subsequently, the electrostatic latent image formed on the photoconductor drum 21 is developed with toner of developer G supplied from the two developing rollers 51 and 52 into a visible toner image while passing through the developing device 4.

After that, the toner image formed on the photoconductor drum 21 is transported to the transfer position opposing the transfer unit 25 by the rotation of the photoconductor drum 21, and is transferred by the transfer unit 25 onto a sheet 9 supplied from the paper feed device 30 through the transport path at a proper timing. After transfer, the peripheral surface of the photoconductor drum 21 is cleaned by the cleaning unit 26.

Next, the sheet 9 on which the toner image is transferred is separated from the photoconductor drum 21, and is transported into the fixing portion in the fixing device 35. When the sheet 9 is heated and pressurized while passing through the fixing portion between the heating rotating body 37 and the pressurizing rotating body 38 in the fixing device 35, the toner image is fixed. After fixing, the sheet 9 is transported out from the fixing device 35, and is output and stored in the output and storage portion 11.

Through the above steps, a monochrome image is formed by toner of one color on one surface of one sheet 9, and the basic image forming operation is completed. When there is a request to perform an image forming operation for a plurality of sheets, the above-described series of steps are similarly repeated the number of times corresponding to the requested number of sheets.

Next, the developing device 4 will be described in detail.

Figure 3:
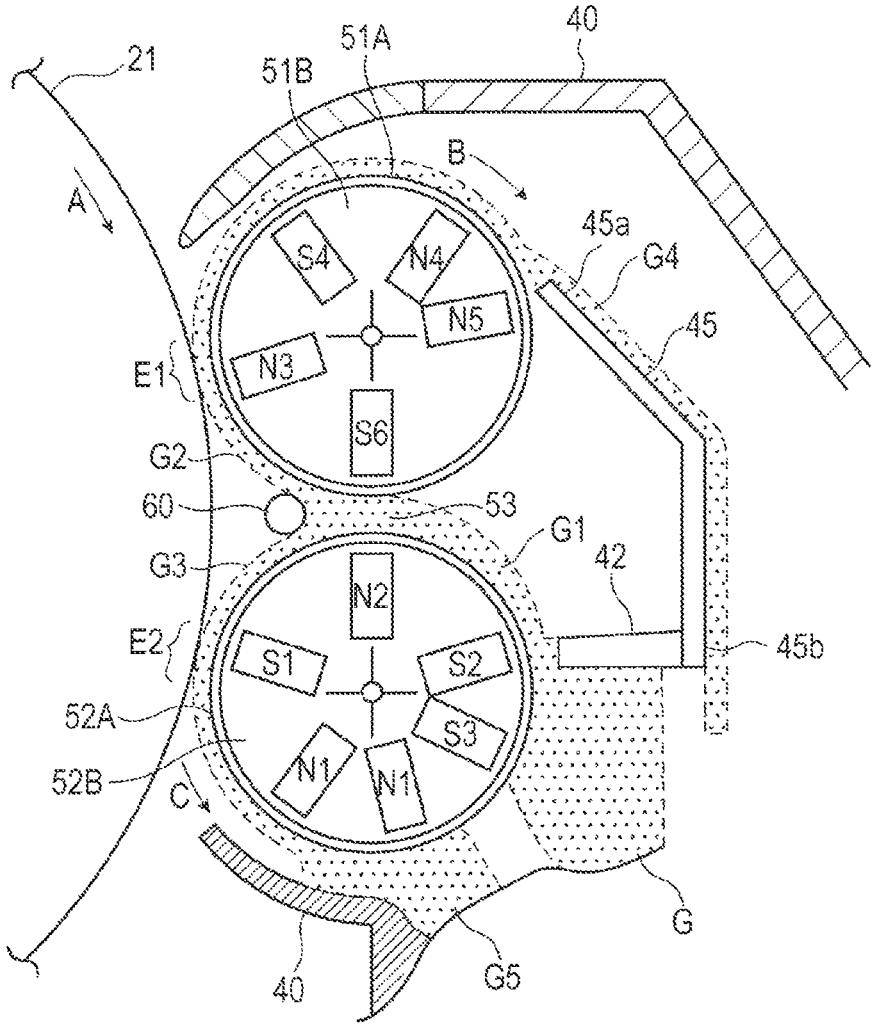
FIG. 3 is an enlarged view of the principal part (e.g., developing rollers and a regulation bar) of the developing device of FIG. 2.
Figure 4:
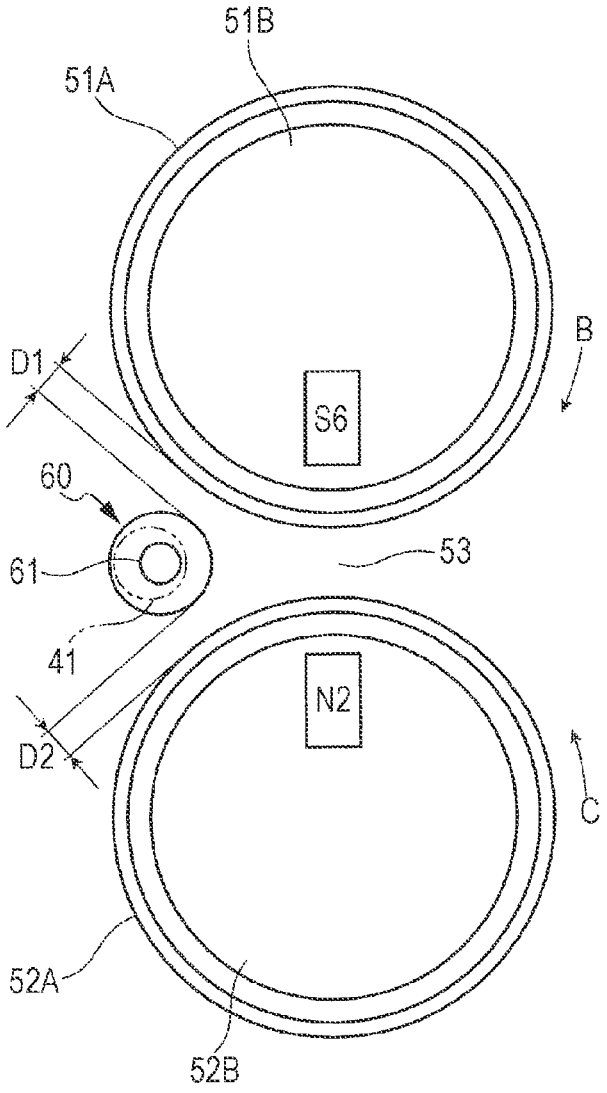
FIG. 4 illustrates a structure of a characteristic part (e.g., magnetic poles and a support state of the regulation bar) of the developing device of FIG. 2.

As illustrated in FIGS. 2 to 4, the developing device 4 has a body section 40 including a storage chamber 40*a* that stores the above-described two-component developer G, and a rectangular opening portion 40*b* provided at a position opposing the photoconductor drum 21. The body section 40 is shaped like a long container having a length more than an axial length of the photoconductor drum 21. A bottom portion of the storage chamber 40*a* has two parallel developer circulating and transporting paths (grooves) that are connected to each other at both ends in a longitudinal direction of the long container and are separated by a partitioning raised portion extending in the longitudinal direction. The developer G is stored in the storage chamber 40*a*.

In the body section 40 of the developing device 4, there are provided two developing rollers 51 and 52 (a first developing roller 51 and a second developing roller 52), two screw augers 55 and 56, a passage restricting plate 42, a regulation bar 60, and a guide plate 45. The first developing roller 51 and the second developing roller 52 transport the developer G to developing regions opposing the photoconductor drum 21 at two positions while holding the developer G by magnetic force. The screw augers 55 and 56 serve as agitation and transport members that agitate and transport the developer G stored in the storage chamber 40*a*. The passage restricting plate 42 restricts the passage of the developer G supplied from the screw auger 56 to the second developing roller 52 so as to regulate the layer thickness (transport amount) of the developer G. The regulation bar 60 divides the developer G transported from the second developing roller 52 onto the first developing roller 51 and the second developing roller 52, and regulates the transport amounts of developer G at the rollers. The guide plate 45 guides and returns the developer G separated from the first developing roller 51 into the storage chamber 40*a*.

As illustrated in FIGS. 2 and 3, the first developing roller 51 and the second developing roller 52 rotate in predetermined directions B and C, respectively, while being partially exposed from the opening portion 40*b* of the body section 40. The two developing rollers 51 and 52 are juxtaposed in a vertical direction substantially parallel to a gravitational direction K (or a slanting direction obliquely intersecting the gravitational direction K). The developing rollers 51 and 52 are also arranged at a required distance from each other. A portion (space) where the developing rollers 51 and 52 are closest to each other serves as a closest portion 53.

The first developing roller 51 includes a cylindrical or substantially cylindrical sleeve 51A that rotates in the direction of arrow B at a position close to a first developing region E1 of the photoconductor drum 21, and a magnet roller 51B fixed to an inner side of the sleeve 51A. The rotating direction B of the sleeve 51A is set such that the moving direction of the sleeve 51A in the first developing region E1 of the photoconductor drum 21 is opposite the rotating (moving) direction A of the photoconductor drum 21. In contrast, the second developing roller 52 includes a cylindrical or substantially cylindrical sleeve 52A that rotates in the direction of arrow C at a position close to a second developing region E2 on a downstream side of the first developing region E1 of the photoconductor drum 21, and a magnet roller 52B fixed to an inner side of the sleeve 52A. The rotating direction B of the sleeve 52A is set such that the moving direction of the sleeve 52A in the second developing region E2 of the photoconductor drum 21 is the same as the rotating (moving) direction A of the photoconductor drum 21.

The sleeves 51A and 52A are formed of a nonmagnetic material (e.g., stainless steel or aluminum) and are each shaped to have a cylindrical portion with almost the same width (length) as that of an effective image forming region of the photoconductor drum 21 in the rotation axis direction. The sleeves 51A and 52A oppose the photoconductor drum 21 such that the rotation axis directions thereof are substantially parallel to the rotation axis direction of the photoconductor drum 21. Further, shaft portions at both ends of each of the sleeves 51A and 52A are rotatably supported by side portions of the body section 40. The sleeves 51A and 52A are rotated in the directions of arrows B and C, respectively, by power transmitted from an unillustrated rotating device via the shaft portions. In addition, a developing voltage is applied from an unillustrated power supply device to the sleeves 51A and 52A so as to form developing electric fields between the sleeves 51A and 52A and the photoconductor drum 21. The developing voltage to be applied is, for example, a direct-current voltage on which an alternating-current component is superimposed.

In the magnet rollers 51B and 52B, a plurality of magnetic poles (S-poles and N-poles) are arranged to generate magnetic force lines such that magnetic carries in the developer G are held in the form of magnetic brushes on the outer peripheral surfaces of the sleeves 51A and 52A. For example, the magnet rollers 51B and 52B are attached with both ends being fixed to the side portions of the body section 40 through inner spaces of the shaft portions of the sleeves 51A and 52A. A plurality of magnetic poles extend in the axial direction of the sleeves 51A and 52A, and are provided at required positions spaced from one another in the circumferential direction (rotating direction) of the sleeves 51A and 52A.

As illustrated in FIGS. 2 and 3, five magnetic poles S6, N3, S4, N4, and N5 are provided in the magnet roller 51B of the first developing roller 51. Among these magnetic poles, the magnetic pole S6 is located at a position closest to the second developing roller 52 (closest position), and serves as a transport pole that transports the developer G supplied from the second developing roller 52 onto the outer peripheral surface of the sleeve 51A while attracting the developer G by magnetic force. The magnetic pole N3 is located at a position opposing the first developing region E1 of the photoconductor drum 21, and serves as a developing pole that contributes the developer G to a developing process. The magnetic pole S4 serves as a transport pole, and the magnetic poles N4 and N5 perform pickoff for separating the developer G from the outer peripheral surface of the sleeve 51A.

As illustrated in FIGS. 2 and 3, six magnetic poles S3, S2, N2, S1, N1, and N1 are arranged in the magnet roller 52B of the second developing roller 52. Among these magnetic poles, the magnetic pole S3 is located at a position substantially opposing a photoconductor-drum-21-side upper end of the screw auger 56 that is close to the second developing roller 52. The magnetic pole S3 performs pickup for attracting and holding the developer G supplied from the screw auger 56 onto the outer peripheral surface of the sleeve 52A by magnetic force. The magnetic pole S2 serves as a regulation-assist pole that stands magnetic brushes in a required size in order to assist in developer regulation of the passage restricting plate 42. The magnetic pole N2 serves as a transport pole located at a position opposing the transport pole S6 in the first developing roller 51. The magnetic pole S1 is located at a position opposing the second developing region E2 of the photoconductor drum 21, and serves as a developing pole that contributes the developer G to the developing process. The magnetic poles N1 and N1 perform pickoff for separating the developer G from the outer peripheral surface of the sleeve 52A by generating magnetic repulsive force.

In particular, as illustrated in FIG. 4, the transport magnetic pole S6 in the magnetic roller 51B of the first developing roller 51 and the transport magnetic pole N2 in the magnetic roller 52B of the second developing roller 52 are located at positions opposing each other with the closest portion 53 being disposed therebetween. Moreover, the magnetic pole S6 and the magnetic pole N2 are set such that magnetic forces (lines) having the same strength similarly and symmetrically act on the regulation bar 60.

As illustrated in FIG. 2, transport blades are spirally wound around peripheral surfaces of the rotation shafts of the screw augers 55 and 56. The screw augers 55 and 56 are rotatably set in the above-described developer circulating and transporting paths in the storage chamber 40*a* of the body section 40, and rotate in directions to transport the developer G in the transporting paths in required directions. The screw augers 55 and 56 are rotated by transmission of a part of power from the rotating device for rotating the sleeves 51A and 52A. The screw auger 56 located near the second developing roller 52 supplies, to the second developing roller 52, a part of the transported developer G.

As illustrated in FIGS. 2 to 4, the passage restricting plate 42 is a rectangular plate having a substantially constant thickness in the principal part and having a length (long side) at least corresponding to the axial length of the sleeve 52A of the second developing roller 52. The passage restricting plate 42 is formed of a nonmagnetic material (e.g., stainless steel). Further, the passage restricting plate 42 is attached to the body section 40 or the guide plate 45 such that one end (lower long side) thereof in the longitudinal direction opposes the outer peripheral surface of the sleeve 52A with a required gap (regulation gap) h therebetween and extends in the axial direction of the sleeve 52A.

The guide plate 45 is a plate member having a surface which receives developer G4 separated from the first developing roller 51 and on which the developer G4 slides down and returns to the storage chamber 40*a*. As illustrated in FIGS. 2 and 3, the guide plate 45 is attached such that an upper end portion 45*a* opposes the midpoint between the magnetic pole N4 and the magnetic pole N5 serving as the separation poles in the first developing roller 51 and such that a lower end 45*b* is in contact with (or fixed to) an end of the passage restricting plate 42.

As illustrated in FIGS. 2 to 4, the regulation bar 60 is a bar-shaped or substantially bar-shaped member extending in the axial direction of the two developing rollers 51 and 52 and having a circular cross section. The regulation bar 60 is located such that it can at least achieve a state opposing the outer peripheral surfaces of the sleeves 51A and 52A of the developing rollers 51 and 52 at predetermined distances D1 and D2 therefrom in an area closer to the photoconductor drum 21 than the closest portion 53 between the developing rollers 51 and 52. Further, the regulation bar 60 is entirely formed of a material having magnetism, and at least a portion opposing the developing rollers 51 and 52 is shaped like a circular column (round bar). For example, the distances D1 and D2 are set to be equal.

As illustrated in FIG. 4, the regulation bar 60 is attached such that projections 61 projecting from both ends thereof are fitted in displacement support recesses (or through-holes) 41 provided in the side face portions of the body section 40 and are supported movably within the areas of the displacement support recesses 41. The areas of the displacement support recesses 41 for restricting the projections 61 of the regulation bar 60 are set to have some room centered on reference positions (portions) that can certainly realize the distances D1 and D2 during movement. Thus, since the projections 61 can freely move in all directions in the areas of the displacement support recesses 41, the position of the regulation bar 60 can be moved in all directions.

Operation of the developing device 4 will be described below.

First, when the image forming apparatus 1 starts an image forming operation, the sleeves 51A and 52A of the two developing rollers 51 and 52 and the screw augers 55 and 56 in the developing device 4 start rotation, and a developing voltage is applied to the sleeves 51A and 52A.

Thus, two-component developer G stored in the storage chamber 40*a* of the body section 40 is transported in the predetermined directions in the two circulating and transporting paths in the storage chamber 40*a* while being agitated by the rotating augers 55 and 56, and is transported in a circulation manner as a whole. At this time, nonmagnetic toner in the developer G is frictionally charged by being sufficiently agitated together with magnetic carriers, and is electrostatically attracted on the surfaces of the carriers.

Subsequently, as illustrated in FIG. 3, part of the two-component developer G transported by the screw auger 56 located near the second developing roller 52 is held on the outer peripheral surface of the sleeve 52A of the second developing roller 52 while being attracted by magnetic force. That is, since magnetic force produced from the magnetic pole S3 in the magnet roller 52B acts on the outer peripheral surface of the rotating sleeve 52A, the magnetic carriers on which the toner is attracted are held and supplied while being connected like chains to form cluster-shaped magnetic brushes.

Next, the two-component developer G held on the sleeve 52A reaches the passage restricting plate 42 while being transported by the rotation of the sleeve 52A. At this time, part of the developer G passes through a gap between the passage restricting plate 42 and the outer peripheral surface of the sleeve 52A, whereby the layer thickness (transport amount) of the developer G is made substantially constant. In contrast, the remaining part of the developer G is dammed by shear force from a side face of the passage restricting plate 42, and most of the dammed developer G is returned into the storage chamber 40*a*.

Next, as illustrated in FIG. 3, developer G1 that has been restricted by the passage restricting plate 42 is separated in two when passing by the regulation bar 60, is distributed to both the first developing roller 51 and the second developing roller 52 after passing through the closest portion 53, whereby the transport amounts of the developer G1 are regulated to be predetermined transport amounts.

In this case, developer G2 distributed to the first developing roller 51 is transported by the sleeve 51A rotating in the direction of arrow B, and receives magnetic force from the magnetic pole N3 and is subjected to a developing electric field of the developing voltage while passing through the first developing region E1 of the photoconductor drum 21. Thus, toner in magnetic brushes of the developer G2 moves to the photoconductor drum 21 and adheres to a latent image passing through the first developing region E1, so that the latent image is developed. Developer G4 that has passed through the first developing region E1 is separated from the outer peripheral surface of the sleeve 51A after passing over the magnetic pole N4 serving as the separation pole, and is then returned into the storage chamber 40*a* along the guide plate 45.

In contrast, developer G3 distributed to the second developing roller 52 is transported by the sleeve 52A rotating in the direction of arrow C, and receives magnetic force from the magnetic pole S1 and is subjected to a developing electric field of the developing voltage while passing through the second developing region E2 of the photoconductor drum 21. Thus, toner in magnetic brushes of the developer G3 moves to the photoconductor drum 21 and adheres to a latent image passing through the second developing region E2, so that the latent image is developed. Developer G5 that has passed through the second developing region E2 is separated from the outer peripheral surface of the sleeve 52A after passing over the magnetic poles N1 serving as the separation poles, and then falls free to return into the storage chamber 40*a*.

In the developing device 4, the regulation bar 60 operates as follows to regulate the transport amount of developer.

Figure 5:
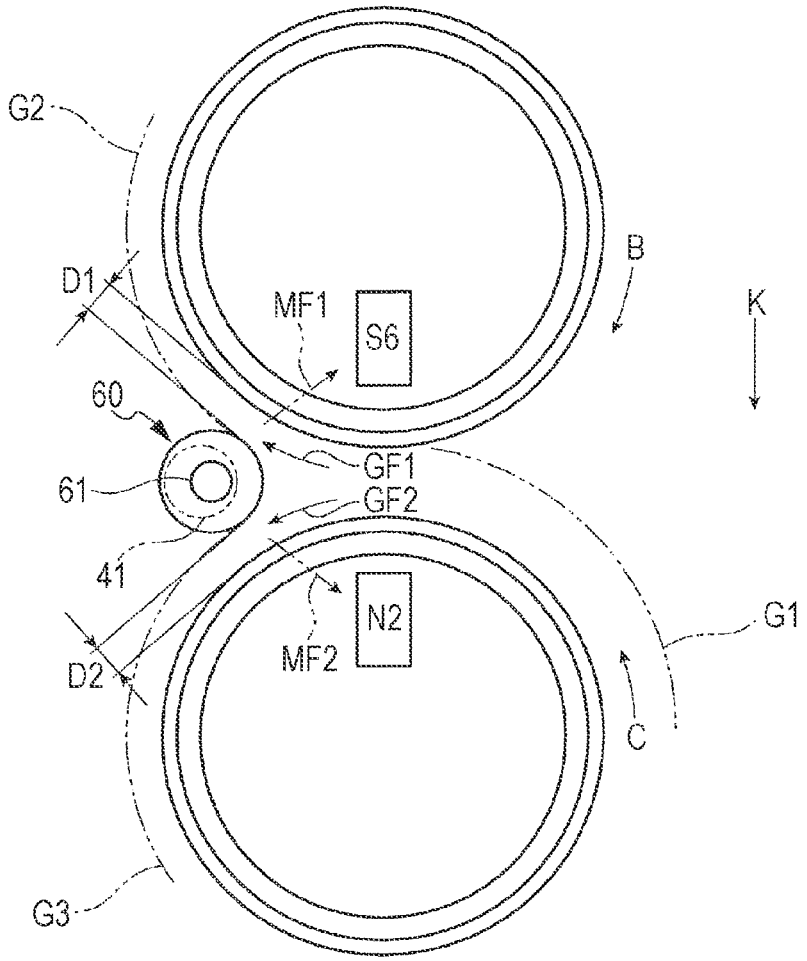
FIG. 5 illustrates autonomous distance adjustment of the regulation bar and a regulation state of the regulation bar for developer in the developing device of FIG. 2.

First, since the regulation bar 60 shows magnetism, it receives attracting forces MF1 and MF2 of the same strength generated by magnetic force lines of the same strength from the transport magnetic pole S6 and the transport magnetic pole N2, as illustrated in FIG. 5. The attracting forces MF1 and MF2 attract the regulation bar 60 toward the developing rollers 51 and 52 (sleeves 51A and 52A). Thus, when the developer G exists or does not exist, the regulation bar 60 is attracted toward the first developing roller 51 and the second developing roller 52 in a balanced manner, and the projections 61 are in contact with the reference portions of the displacement support recesses 41 (portions that can maintain the equal distance), so that the regulation bar 60 is held at the equal distance from the developing rollers 51 and 52.

Further, as illustrated in FIG. 5, when the developer G exists, the developer G1 supplied via the second developing roller 52 passes through the closest portion 53 between the developing rollers 51 and 52 and is separated in two, that is, into the developer G2 and the developer G3 by contact with the regulation bar 60, and the developer G2 and the developer G3 receive forces GF1 and GF2 for pushing the regulation bar 60, respectively, during movement. These pushing forces GF1 and GF2 are equal because the regulation bar 60 is located at the equal distance from the developing rollers 51 and 52 and substantially separates the developer G1 in two because of the attracting forces MF1 and MF2 from the magnetic poles. Thus, the regulation bar 60 keeps on receiving the pushing forces GF1 and GF2 of the same strength in a balanced manner from the developer G2 and the developer G3 that are separated and are distributed. This also keeps the regulation bar 60 at the equal distance from the developing rollers 51 and 52.

At this time, since the pushing forces GF1 and GF2 are set to be less than the attracting forces MF1 and MF2 of the magnetic poles, the projections 61 of the regulation bar 60 are kept in contact with the reference portions of the displacement support recesses 41. Further, when the regulation bar 60 is moved closer to one of the developing rollers 51 and 52, it receives one of the pushing forces GF1 and GF2 of the developer, and is thereby moved to return to the original balanced position.

In this way, the regulation bar 60 receives the attracting forces MF1 and MF2 from the magnetic poles and the pushing forces GF1 and GF2 from the developer, and therefore, exists as if it was floating in the developer in a balanced manner. The regulation bar 60 is supported to autonomously adjust the distances from the developing rollers 51 and 52 to the required distances D1 and D2. Incidentally, the weight of the regulation bar 60 does not have any influence on autonomous distance adjustment because the influence of the attracting forces MF1 and MF2 is strong.

Therefore, as illustrated in FIGS. 4 and 5, the developer G1 supplied to the second developing roller 52 passes through the closest portion 53 between the first developing roller 51 and the second developing roller 52, is separated in two by contact with the regulation bar 60 supported at the equal distances D1 and D2 from the developing rollers 51 and 52, and is finally distributed to the developing rollers 51 and 52 as the developer G2 and the developer G3 whose transport amounts are regulated to the required transport amounts by the regulation bar 60.

For this reason, the distances of the regulation bar 60 from the developing rollers 51 and 52 are autonomously adjusted in the developing device 4. Hence, a mechanism and an operation for adjusting the distances are unnecessary. This simplifies the structure and enhances ease in handling. In the image forming apparatus 1 using the developing device 4, since the operation for adjusting the distances of the regulation bar 60 in the developing device 4 is unnecessary, the developing device 4 is easily handled, and stable image formation can be performed.

Second Exemplary Embodiment

Figure 6:
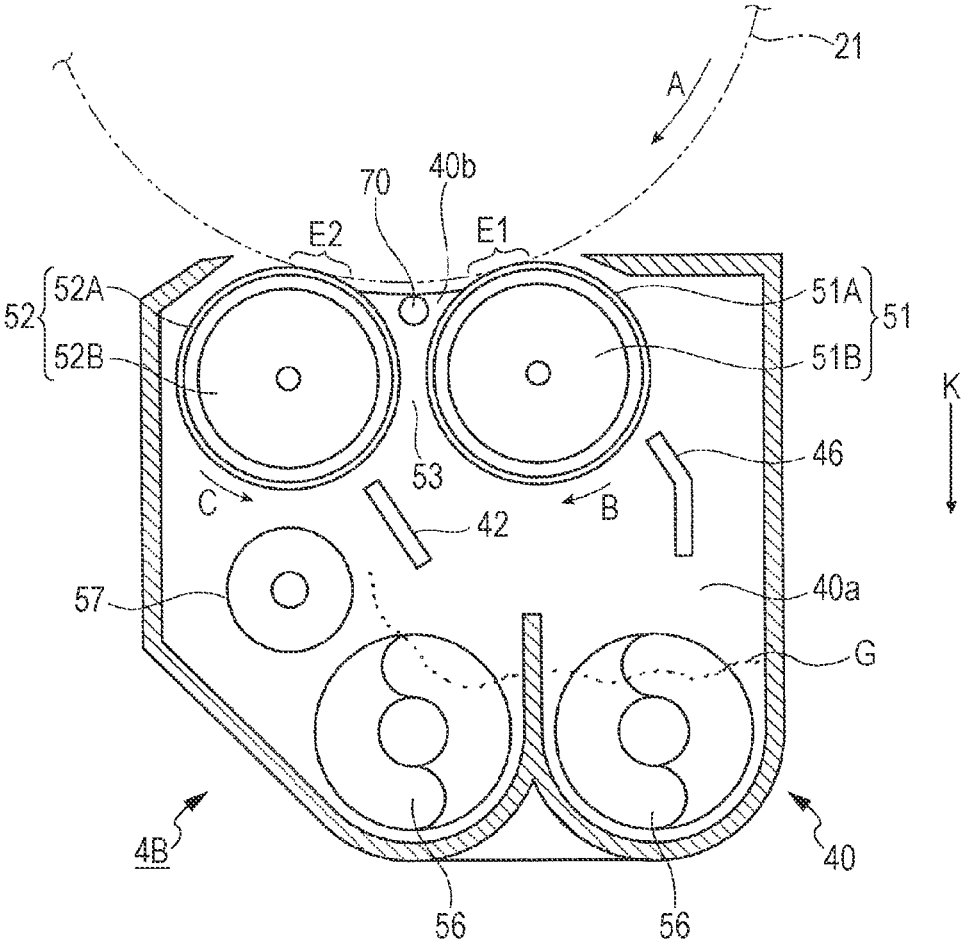
FIG. 6 is a schematic cross-sectional view of a developing device according to a second exemplary embodiment.
Figure 7:
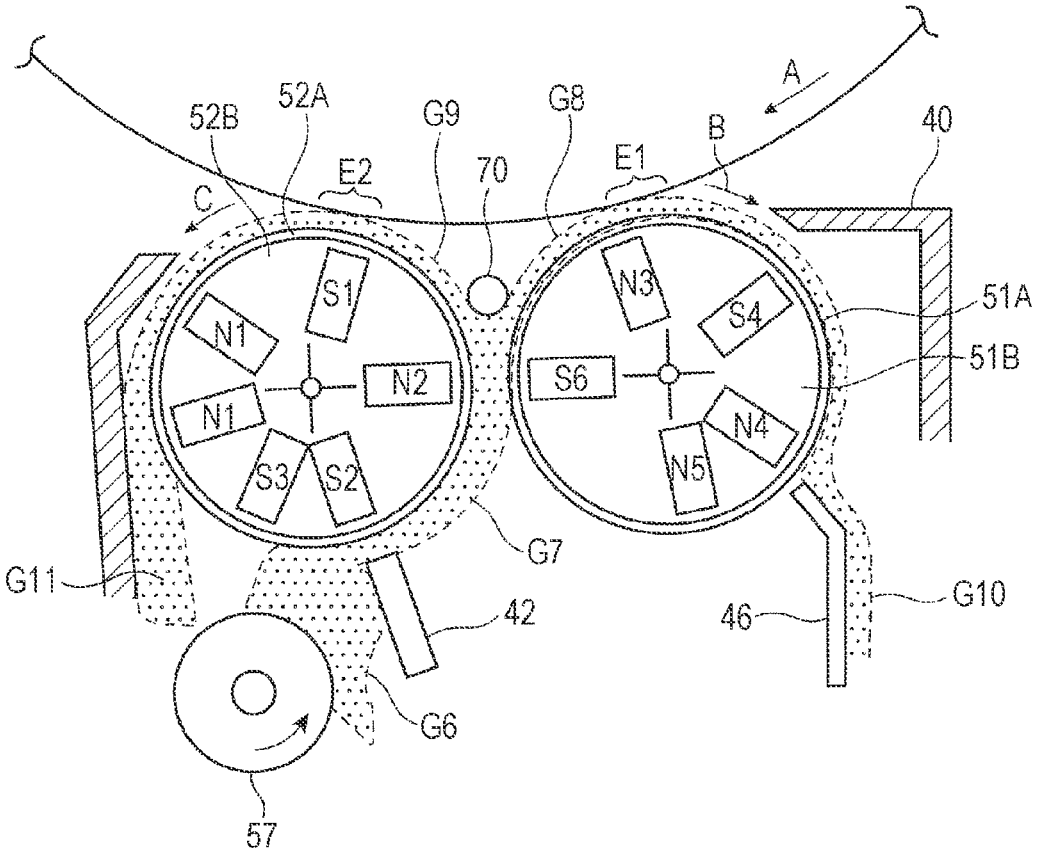
FIG. 7 is an enlarged view of the principal part (e.g., developing rollers and a regulation bar) of the developing device of FIG. 6.

FIGS. 6 and 7 illustrate a developing device 4B according to a second exemplary embodiment. FIG. 6 illustrates an overall structure of the developing device 4B, and FIG. 7 illustrates the principal part of the developing device 4B.

The developing device 4B of the second exemplary embodiment is used in a state opposing a lower portion of a photoconductor drum 21 on a downstream side in a gravitational direction K. For that purpose, two developing rollers 51 and 52 are arranged in a horizontal direction substantially orthogonal to the gravitational direction K, and a regulation bar 70 showing non-magnetism is provided. Other structures of the developing device 4B are similar to those adopted in the developing device 4 of the first exemplary embodiment. The horizontal direction includes a case in which a straight line connecting the center lines of the two developing rollers 51 and 52 intersects the gravitational direction K at 80 to 100 degrees.

That is, the developing device 4B includes, in a body section 40, two developing rollers 51 and 52 (a first developing roller 51 and a second developing roller 52), two screw augers 55 and 56, a supply roller 57, a passage restricting plate 42, a regulation bar 70, and a guide plate 46. The supply roller 57 supplies, to the second developing roller 52, part of developer transported by the screw auger 56. The regulation bar 70 distributes developer G transported from the second developing roller 52 to the first developing roller 51 and the second developing roller 52 and regulates the transport amount. The guide plate 46 guides and returns the developer G separated from the first developing roller 51 into a storage chamber 40*a*.

The regulation bar 70 is a bar-shaped or substantially bar-shaped member extending in an axial direction of the developing rollers 51 and 52 and having a circular cross section. The regulation bar 70 opposes outer peripheral surfaces of sleeves 51A and 52A of the developing rollers 51 and 52 in an area closer to the photoconductor drum 21 than a closest portion 53 between the developing rollers 51 and 52 with predetermined distances D3 and D4 therebetween. Further, the regulation bar 70 is entirely formed of a material having non-magnetism, and at least a portion opposing the developing rollers 51 and 52 is shaped like a circular column (round bar). For example, the distances D3 and D4 are set to be equal.

Figure 8:
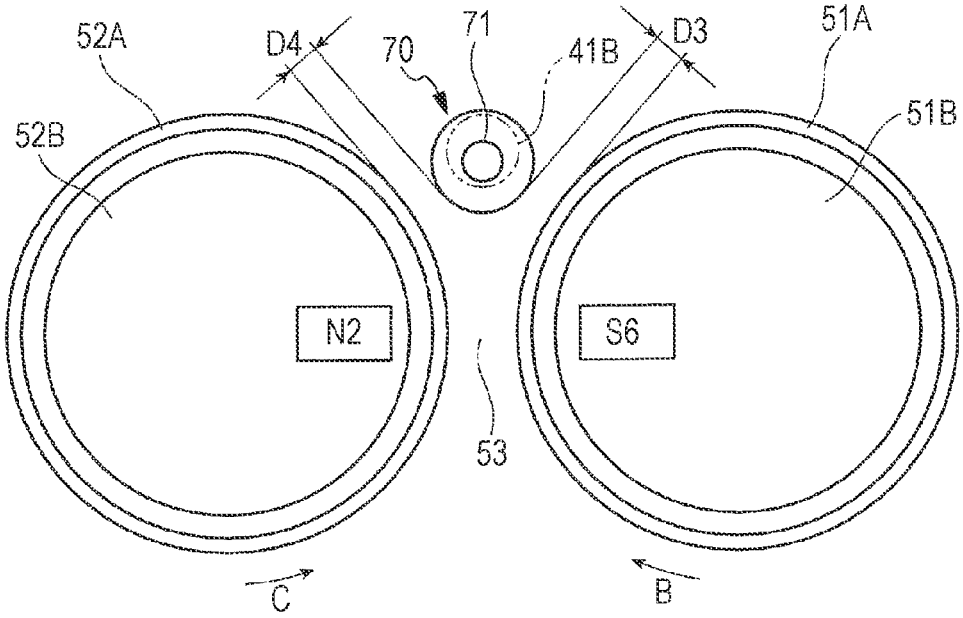
FIG. 8 illustrates a structure of a characteristic part (e.g., magnetic poles and a support state of the regulation bar) of the developing device of FIG. 6.

As illustrated in FIG. 8, the regulation bar 70 is attached such that projections 71 projecting from both ends are fitted in displacement support recesses (or through-holes) 41B provided in side face portions of the body section 40 and are supported movably within the areas of the displacement support recesses 41B. The areas of the displacement support recesses 41B for restricting the projections 71 of the regulation bar 70 are set to have some room centered on reference positions (portions) that can certainly realize the predetermined distances D3 and D4 during movement. Thus, the projections 71 of the regulation bar 70 can freely move in all directions within the areas of the displacement support recesses 41B, and the position of the regulation bar 70 can be moved in all directions.

The first developing roller 51 and the second developing roller 52 respectively include cylindrical or substantially cylindrical sleeves 51A and 52A, and magnet rollers 51B and 52B fixed to inner sides of the sleeves 51A and 52A and having a plurality of magnetic poles, as illustrated in FIG. 7. For example, the supply roller 57 is formed by a sponge roller or a roller in which a magnet roller is provided in a cylindrical sleeve. The guide plate 46 is attached such that an upper end portion thereof opposes a portion between magnetic poles N4 and N5 serving as separation poles in the first developing roller 51.

Operation of the developing device 4B will be described below.

First, when the image forming apparatus 1 starts an image forming operation, two-component developer G stored in the storage chamber 40*a* of the body section 40 in the developing device 4B is transported in the respective directions in two circulating paths in the storage chamber 40*a* while being agitated by the rotating augers 55 and 56, and is transported in a circulating manner as a whole.

Next, as illustrated in FIG. 7, part G6 of the two-component developer G transported by the screw auger 56 located near the second developing roller 52 is held and attracted via the supply roller 57 on the outer peripheral surface of the sleeve 52A of the second developing roller 52 by magnetic force. Next, when the two-component developer G6 held on the second developing roller 52 is transported with the rotation of the sleeve 52A and passes by the passage restricting plate 42, the layer thickness (transport amount) of part G7 of the developer is made substantially constant. In contrast, the remaining developer G is dammed by shear force from a side face of the passage restricting plate 42, and most of the dammed developer G is returned into the storage chamber 40*a*.

Figure 9:
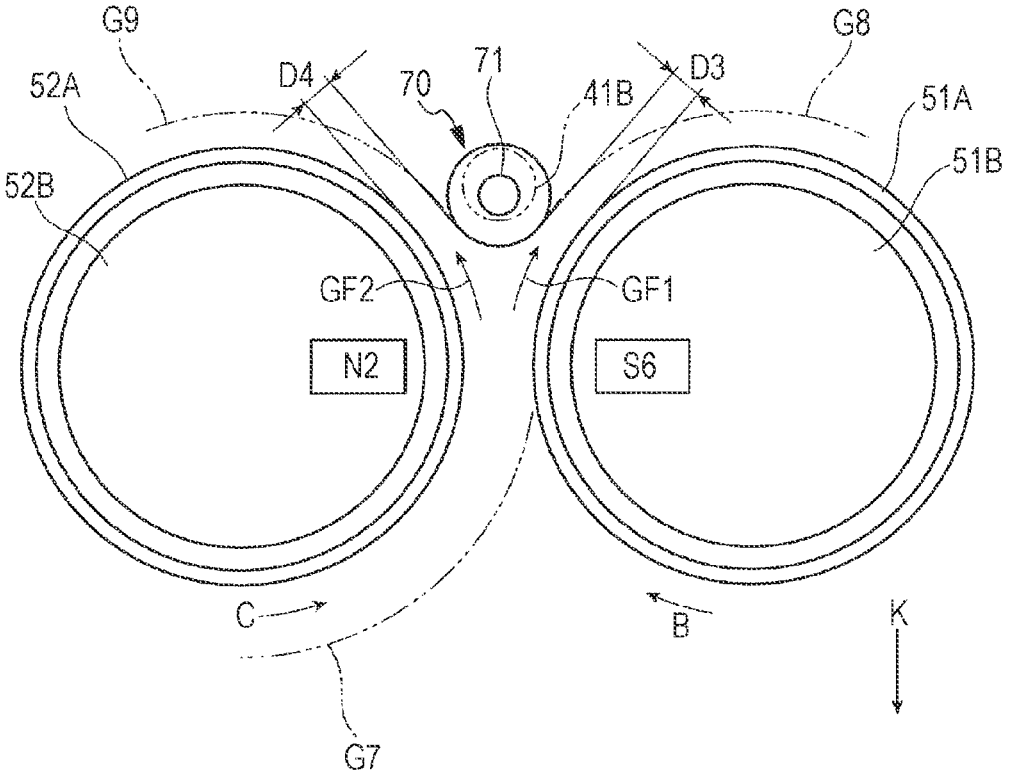
FIG. 9 illustrates autonomous distance adjustment of the regulation bar and a regulation state of the regulation bar for developer in the developing device of FIG. 6.

Subsequently, as illustrated in FIGS. 7 and 9, the developer G7 restricted by the passage restricting plate 42 is separated in two when passing by the regulation bar 70 after passing through the closest portion 53, and is distributed to both the first developing roller 51 and second developing roller 52, so that the transport amount of the developer is regulated to the required transport amount.

In this case, when developer G8 distributed to the first developing roller 51 is transported by the sleeve 51A rotating in the direction of arrow B and passes through a first developing region E1, it receives magnetic force from a developing magnetic pole N3 and is subjected to a developing electric field due to the developing voltage. Thus, toner in magnetic brushes of the developer G8 moves to the photoconductor drum 21 and adheres to a latent image passing through the first developing region E1, so that the latent image is developed. Developer G10 that has passed through the first developing region E1 passes between the magnetic poles N4 and N5 serving as separation poles, and is then separated from the outer peripheral surface of the sleeve 51A. After that, the developer G10 is returned to the storage chamber 40*a* along the guide plate 46.

In contrast, when developer G9 distributed to the second developing roller 52 is transported by the sleeve 52A rotating in the direction of arrow C and passes through a second developing region E2 of the photoconductor drum 21, it receives magnetic force from a developing magnetic pole S1 and is subjected to a developing electric field due to the developing voltage. Thus, toner in magnetic brushes of the developer G9 moves to the photoconductor drum 21 and adheres to a latent image passing through the second developing region E2, so that the latent image is developed. Developer G11 that has passed through the second developing region E2 passes by magnetic poles N1 and N1 serving as separation poles, falls out of the outer peripheral surface of the sleeve 52A, and is then returned into the storage chamber 40*a*.

In the developing device 4B, the regulation bar 70 operates to regulate the transport amount of developer as follows.

First, as illustrated in FIG. 9, the regulation bar 70 receives force in a gravitational direction K because of its own weight. Thus, when the developer G exists and does not exist, the projections 71 of the regulation bar 70 are in contact with the reference positions of the displacement support recesses 41B (lower portions that can maintain the equal distance), and the regulation bar 70 is held at an equal distance from the two developing rollers 51 and 52.

As illustrated in FIG. 9, when the developer G exists, the developer G7 supplied via the second developing roller 52 passes through the closest portion 53 between the developing rollers 51 and 52, and is then separated into developer G8 and developer G9 by contact with the regulation bar 70. The developer G8 and the developer G9 respectively receive forces GF1 and GF2 for pushing the regulation bar 70 upward from below during movement. Since the regulation bar 70 is located at the equal distance from the developing rollers 51 and 52 because of its own weight, it substantially separates the developer G7 in two. Hence, these pushing forces GF1 and GF2 have the same strength. Thus, the regulation bar 70 receives, in a balanced manner, the pushing forces GF1 and GF2 of the same strength from the developer G8 and G9 separated and distributed. This also holds the regulation bar 70 at the equal distance from the developing rollers 51 and 52.

At this time, since the pushing forces GF1 and GF2 are set to be less than the force of the weight of the regulation bar 70, the projections 71 of the regulation bar 70 are kept in contact with the reference portions of the displacement support recesses 41B. Further, when the regulation bar 70 is moved closer to one of the developing rollers 51 and 52, it principally receives one of the pushing forces GF1 and GF2 of the developer, and is thereby moved and returned to the original balanced position.

In this way, the regulation bar 70 receives the force of its own weight and the pushing forces GF1 and GF2 of the developer, exists as if it was floating in the developer in a balanced state, and is supported and autonomously adjusted to maintain the required distances D1 and D2 from the developing rollers 51 and 52. Incidentally, although the regulation bar 70 receives the magnetic forces due to the magnetic force lines from the magnetic pole S6 and the magnetic pole N2 opposing the regulation bar 70 in the closest portion 53 between the developing rollers 51 and 52, it is not magnetically influenced because of its non-magnetism. Hence, there is no influence on autonomous distance adjustment.

Therefore, as illustrated in FIG. 9, the developer G7 supplied to the second developing roller 52 passes through the closest portion 53 between the first developing roller 51 and the second developing roller 52, and is then separated in two by contact with the regulation bar 70 supported at the equal distances D3 and D4 from the developing rollers 51 and 52. Finally, the developer G7 is distributed, to the developing rollers 51 and 52, as developer G8 and developer G9 whose transport amounts are regulated to the required transport amounts by the regulation bar 70.

For this reason, in the developing device 4B, the distances of the regulation bar 70 from the two developing rollers 51 and 52 are also autonomously adjusted, and a mechanism and an operation for adjusting the distances are unnecessary. This simplifies the structure and enhances ease in handling. Further, in the image forming apparatus using the developing device 4B, an operation of the developing device 4B for adjusting the distances of the regulation bar 70 is also unnecessary. Hence, the developing device 4B is easily handled, and stable image formation can be performed.

Other Exemplary Embodiments

While the regulation bars 60 and 70 are shaped like a round bar in the first and second exemplary embodiments, the regulation member may have other shapes (e.g., a bar of elliptic cross section). The number and positions of magnetic poles provided in the magnet rollers 51B and 52B of the developing rollers 51 and 52 are not limited to those adopted in the first and second exemplary embodiments, and other structures can be adopted.

The type of the image forming apparatus using the developing device 4 or 4B of the present invention is not particularly limited as long as the image forming apparatus can use the developing device 4 or 4B. For example, the image forming apparatus may use a belt-shaped latent-image carrier instead of the photoconductor drum 21.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a first developing roller including a substantially cylindrical first transport member that transports developer showing magnetism by rotating while being close to a latent-image carrier rotating in one direction, the first transport member moving in a direction opposite the one direction, and a first magnet member fixed to an inner side of the first transport member and including a plurality of magnetic poles;

a second developing roller including a substantially cylindrical second transport member that transports the developer showing the magnetism by rotating while being close to the latent-image carrier at a position on a downstream side of the first developing roller in the one direction, the second transport member moving in the same direction as the one direction, and a second magnet member fixed to an inner side of the second transport member and including a plurality of magnetic poles; and a regulation member that distributes the developer to be supplied to the first developing roller and the second developing roller so as to regulate transport amounts of the developer on the first and second developing rollers to required transport amounts, the regulation member opposing the first and second developing rollers with predetermined distances therebetween in an axial direction of the first and second developing rollers, wherein the first developing roller and the second developing roller are spaced from each other in horizontal direction substantially orthogonal to a gravitational direction, and wherein the regulation member is movably supported in an area closer to the latent-image carrier than a position where the first developing roller and the second developing roller are closest to each other, and the regulation member is formed by one substantially bar-shaped member showing non-magnetism.

2. An image forming apparatus comprising:

a rotating latent-image carrier; and the developing device according to claim 1, the developing device developing a latent image by supplying developer to the latent-image carrier.

3. The developing device according to claim 1, wherein the regulation member comprises a plurality of projections which freely move in all directions within an area of displacement support recesses.

* * * * *